US006559586B1

(12) United States Patent
Alig et al.

(10) Patent No.: US 6,559,586 B1
(45) Date of Patent: May 6, 2003

(54) COLOR PICTURE TUBE INCLUDING AN ELECTRON GUN IN A COATED TUBE NECK

(75) Inventors: Roger Casanova Alig, Princeton, NJ (US); Dennis John Bechis, Yardly, PA (US); David Arthur New, Mercerville, NJ (US)

(73) Assignees: Sarnoff Corporation, Princeton, NJ (US); Samsung Display Devices, Co., LTD, Kyungki-Do (KR)

( * ) Notice: Subject to any disclaimer, the term of this patent is extended or adjusted under 35 U.S.C. 154(b) by 234 days.

(21) Appl. No.: 09/621,575

(22) Filed: Jul. 21, 2000

Related U.S. Application Data

(60) Provisional application No. 60/181,104, filed on Feb. 8, 2000.

(51) Int. Cl.[7] ..... H01J 29/70

(52) U.S. Cl. ..... 313/427; 313/414; 313/449; 313/450; 313/416

(58) Field of Search ..... 313/414, 448, 313/449, 450, 416, 427

(56) References Cited

U.S. PATENT DOCUMENTS

| | | | | |
|---|---|---|---|---|
| 2,714,176 A | | 7/1955 | Friend | |
| 2,726,347 A | | 12/1955 | Benway | |
| 2,726,348 A | | 12/1955 | Benway | |
| 2,861,208 A | * | 11/1958 | Benway | 313/412 |
| 3,011,090 A | | 11/1961 | Moodey | |
| 3,024,380 A | | 3/1962 | Burdick et al. | |
| 3,873,879 A | | 3/1975 | Hughes | |
| 4,168,452 A | * | 9/1979 | Christensen et al. | 315/16 |
| 4,317,065 A | | 2/1982 | Hughes | |
| 4,345,183 A | * | 8/1982 | Fukuda | 313/412 |
| 4,543,508 A | * | 9/1985 | Saito | 430/21 |
| 4,581,560 A | * | 4/1986 | Shirai et al. | 313/414 |
| 4,590,403 A | | 5/1986 | Alig | |
| 4,599,534 A | * | 7/1986 | Shirai et al. | 313/414 |
| 4,614,894 A | | 9/1986 | Izumida | |
| 4,614,895 A | * | 9/1986 | Saito et al. | 313/429 |
| 4,701,678 A | * | 10/1987 | Blacker et al. | 315/582 |
| 4,771,216 A | | 9/1988 | Blacker et al. | |
| 4,945,284 A | | 7/1990 | Shimoma et al. | |
| 5,382,871 A | | 1/1995 | Funahashi et al. | |
| 5,488,265 A | | 1/1996 | Chen | |
| 5,659,225 A | * | 8/1997 | Tsuruoka et al. | 313/414 |
| 5,939,820 A | * | 8/1999 | Jo | 313/449 |

OTHER PUBLICATIONS

K. Nishimura, S. Nakata, K. Oono, S. Okuda, "Newly Developed Designing Technique For A Main Lens Of An Electron Gun For CRT's", CRTp–2, IDW'97, Proceedings of the Fourth International Display Workshops, Nagoya, Japan, 1997, 6 Pages.

K. Oono, S. Nakata, and S. Okuda, "Low Aberration Lens Systems For Color Display Tubes",CRT 3–4, IDW'97, Proceedings of the Fourth International Display Workshops, Nagoya, Japan, 1997, 6 Pages.

* cited by examiner

*Primary Examiner*—Ashok Patel
*Assistant Examiner*—Glenn Zimmerman
(74) *Attorney, Agent, or Firm*—William J. Burke

(57) ABSTRACT

A cathode ray tube and a plural beam electron gun therefor include a main lens that comprises a tubular focus grid G5 and a conductive coating on the inner surface of the tube neck. The neck coating extends from the region of focus grid G5 towards the faceplate of the cathode ray tube. Preferably, the exit of the focus grid G5 is non-planar and is curved or undulated and focus grid G5 includes an aperture plate intermediate its entrance and exit. The aperture plate preferably has an elliptical center beam opening and connected-semi-elliptical outer-beam openings, to better converge and focus the outer and center electron beams. Also preferably, the focus grid G5 is centrally located in the tube neck and at least partly surrounded by the conductive neck coating.

30 Claims, 3 Drawing Sheets

COLOR PICTURE TUBE INCLUDING AN ELECTRON GUN IN A COATED TUBE NECK

This Application claims the benefit of U.S. Provisional Application Ser. No. 60/181,104 filed Feb. 8, 2000.

The present invention relates to a cathode ray tube and electron gun therefor, and, in particular, to a cathode ray tube and electron gun therefor including a conductively coated tube neck.

Color picture tubes are cathode ray tubes that typically include an electron gun producing three beams of electrons that are deflected by a magnetic deflection yoke to be raster scanned and to pass through apertures patterned in a shadow mask to impinge upon a faceplate or screen having a corresponding pattern of phosphors thereon. The pattern is of different phosphors that produce light of different colors, e.g., red, green and blue light producing phosphors, when impinged upon by a beam of electrons, i.e. each beam being for producing one of the three colors. Many conventional color tubes employing such three-beam electron guns are described in the following U.S. Patents:

U.S. Pat. No. 2,714,176 issued to Friend,

U.S. Pat. No. 2,726,347 issued to Benway,

U.S. Pat. No. 2,726,348 issued to Benway,

U.S. Pat. No. 2,861,208 issued to Benway,

U.S. Pat. No. 3,011,090 issued to Moodey,

U.S. Pat. No. 3,024,380 issued to Burdick et al,

U.S. Pat. No. 4,317,065 issued to Hughes,

U.S. Pat. No. 3,873,879 issued to Hughes,

U.S. Pat. No. 4,590,403 issued to Alig,

U.S. Pat. No. 4,614,894 issued to Izumida et al,

U.S. Pat. No. 4,945,284 issued to Shimoma, et. al,

U.S. Pat. No. 5,382,871 issued to Funahashi, et. al.

U.S. Pat. No. 5,488,265 issued to Chen

Three beam electron guns typically have three electron generating cathodes and a plurality of electron beam forming and focusing electrodes, each typically having three apertures through which the respective beams pass. Such beam forming electrode structures, which are also sometimes called electron lenses, sometimes have a single common opening through which the three beams pass, but have three-aperture plates through which the electrons enter and leave the lens.

Whether the three electron generating cathodes are in a triangular array, the so-called "delta" gun, or are in a straight side-by-side array, the so-called "in-line" gun, the electron beams travel through the various lenses along generally parallel trajectories and the apertures of each electrode are in the same array, either delta or in-line, as are the cathodes. An exception is the Trinitron electron gun which has common openings through which the three electron beams pass, but the three beams cross within the lens and must be redirected to the proper direction upon exiting the Trinitron lens.

The "conventional wisdom" is that electron guns require focus and anode grids with three-aperture electrode plates to converge and to focus the three beams. Moreover, it is usual that, as it is desired to "improve" the electron gun, additional electrode structures be introduced to further shape and/or bend the electron beam. Thus, conventional electron guns tend to have a large number of metal electrodes or grids, including focus and anode grids.

Thus, it would be desirable to have an electron gun, and a cathode ray tube employing such gun, which does not require electrodes having a separate aperture for each electron beam, and that produces three electron beams that are substantially self converging to a single spot on the faceplate. It is also desirable that such electron gun, and a cathode ray tube employing such gun, have a larger diameter lens so as to reduce, or at least not increase, any aberration and spot distortion experienced by any of the electron beams.

To this end, the electron gun for producing at least three beams of electrons of the present invention comprises at least three electron sources for producing the at least three beams of electrons, a pre-focus lens for at least partly focusing each of the beams of electrons, and a main lens. According to one aspect of the invention, the main lens of the electron gun includes a hollow electrode for focusing and converging the at least three beams of electrons, the electrode having a non-uniform dimension iri the direction of electron travel therethrough thereby to define a substantially open non-planar exit aperture. According to another aspect of the invention, the main lens of the electron gun includes a hollow electrode for focusing and converging the at least three beams of electrons, the hollow electrode having an entrance and an exit opening, and an aperture plate intermediate the entrance and the exit opening, wherein the aperture plate has at least an elliptical center opening and two outer openings defined by two connected semi-ellipses through which respective ones of the at least three electron beams pass.

BRIEF DESCRIPTION OF THE DRAWING

The detailed description of the preferred embodiments of the present invention will be more easily and better understood when read in conjunction with the FIGURES of the Drawing which include.

Figure 1:
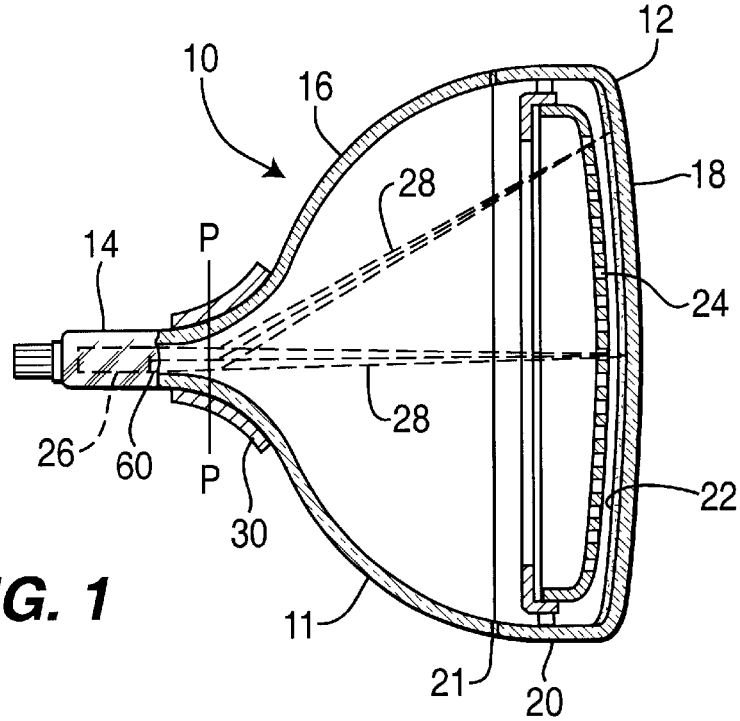
FIG. 1 is a plan view, partly in axial section, of a color picture tube embodying the present invention.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature.

DESCRIPTION OF THE PREFERRED EMBODIMENT

FIG. 1 shows a rectangular faceplate color picture tube 10, i.e. a cathode ray tube of the sort useful in a television receiver, computer display, video monitor or the like. Tube 10 has a glass envelope 11 comprising a rectangular faceplate panel 12 and a tubular neck 14 connected by a generally rectangular funnel 16. Faceplate panel 12 includes a viewing faceplate 18 and a peripheral flange or side wall 20 which is sealed to funnel 16 with a glass frit seal 21. A mosaic pattern phosphor screen 22 of three phosphors producing light of three different colors is located on the inner surface of faceplate 12, 18. The mosaic pattern may be one of an in-line pattern or a dot pattern, but preferably is a line pattern in which the lines extend substantially perpendicular to the direction of the high frequency scan (e.g., the horizontal scan in a television tube and normal to the plane of the paper on which FIG. 1 is drawn).

Tube 10 includes a multiple aperture shadow mask 24 or other color selection electrode that is preferably removably mounted in conventional manner a predetermined spaced apart distance from phosphor screen 22. An electron gun 26 having an open main lens is centrally positioned radially within tube neck 14 and produces three electron beams 28 that are directed towards screen 22, initially parallel to the Z axis. Electron gun 26 ends in a focus grid G5. A conductive coating on the inside surface of tubular tube neckA 4 surrounding the final electrode of electron gun 26, i.e. a focus grid G5, and extending a predetermined distance toward screen 22. Electron beams 28 follow coplanar convergent paths through the apertures of shadow mask 24 to impinge upon the phosphors on screen 22.

Deflection yoke 30 fits against tube 10 in the region of the funnel 16 to neck 14 junction surrounding the three electron beams 28. Yoke 30 is activated with deflection drive signals such as vertical and horizontal drive signals to magnetically deflect beams 28 to scan over screen 22 vertically (i.e. in the Y axis direction) and horizontally (i.e. in the X axis direction) in a rectangular raster. Deflection begins in the region indicated by line P—P of FIG. 1 at about the middle of yoke 30, however fringes of the magnetic field produced by yoke 30 extend axially along the Z axis rearward and forward of line P—P, including into the region near electron gun 26. The actual deflection trajectories are not shown in FIG. 1, but are illustrated in a somewhat simplified manner.

Figure 3:
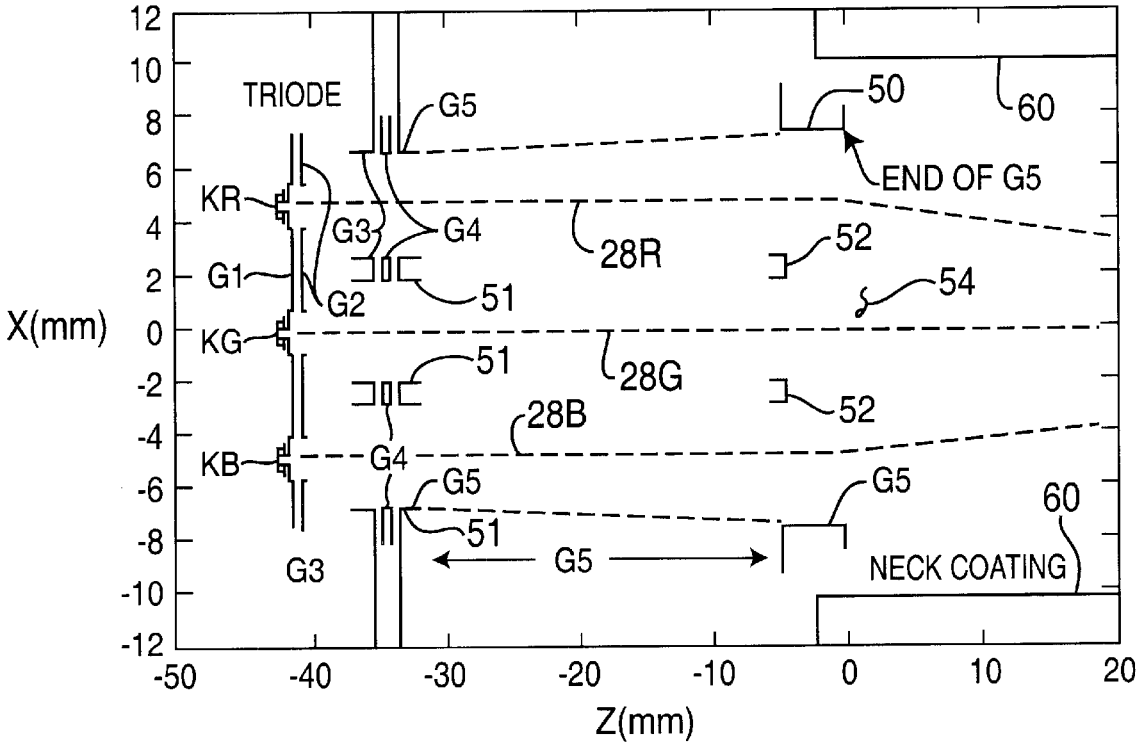
FIG. 3 is a graphical schematic representation illustrating an exemplary electrode arrangement through which the electron beams pass within an exemplary electron gun including the electrode structure of FIGS. 2A, 2B and 2C.
Figure 2A:
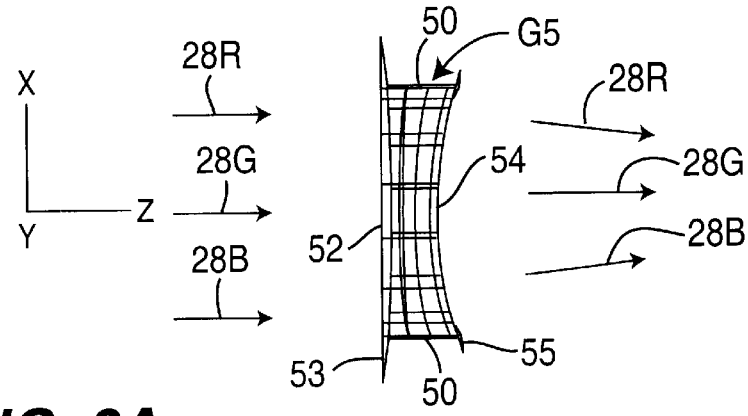
FIGS. 2A, 2B and 2C are schematic diagrams of a plan view, a side view and an isometric view, respectively, of an exemplary embodiment of an upper or exit end focus electrode structure of an electron gun according to the invention.
Figure 2B:
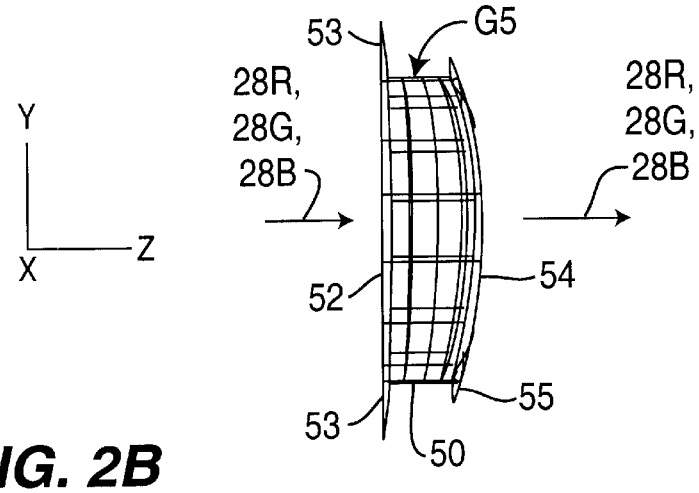
Figure 2C:
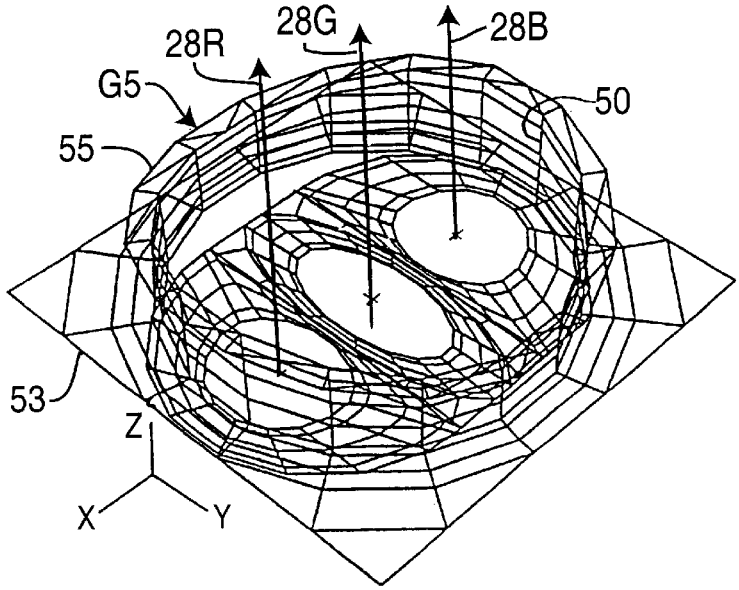

Electron gun 26 is described below in relation to FIGS. 2A, 2B, 2C and 3. In particular, FIGS. 2A, 2B and 2C are schematic diagrams of a plan view, a side view and an isometric view, respectively, of an exemplary embodiment of an axially positioned "upper end" or "exit end" of a focus grid G5 electrode structure of an electron gun 26 according to the invention. The "lower end" or "entrance end" aperture plate 51 of focus grid G5 is shown in FIG. 3 and described below. Together, focus grid G5 and the conductive coating on the interior of tube neck 14 may be referred to as the main lens, i.e. the main electron lens, of electron gun 26. Three beams of electrons 28R, 28G, 28B move along trajectories that pass through the central openings of the focus grid G5 electrode structure to exit electron gun 26 traveling in a direction toward screen 22 of tube 10. The centers of beams 28R, 28G, 28B intersect the X axis with the center beam also intersecting the Y axis and with the outer beams 28R, 28B substantially symmetrically spaced away in the ±X directions from center beam 28G.

Focus grid G5 and neck coating 60 together comprise a main lens to focus the three electron beams 28 as they exit electron gun 26 so that each beam reaches screen 22 in a relatively tight bundle to produce an acceptably small spot size. In addition, focus grid G5 and neck coating 60 together preferably converge the outer two electron beams 28R, 28B so that, apart from deflection by magnetic deflection yoke 30, they impinge upon screen 22 at the intersection of the central axis of tube 10 and screen 22 where they are coincident with the center beam which impinges upon screen 22 at the same point due to the symmetry of tube 10, i.e. all three beams 28 are "free-fall" converged. Preferably, the three electron sources that produce the three electron beams 28R, 28G, 28B are in side-by-side relationship, as shown in FIG. 3, for producing three beams of electrons that are directed toward screen 22 and that travel in substantially the same plane, i.e. the three electron beams are substantially co-planar and in the X-Z plane within electron gun 26 prior to being deflected by deflection yoke 30.

The exit of focus grid G5 is non-planar, i.e. it is curved so as not to lie in a single plane and is curved in a direction to preferably converge the outer two electron beams. It is noted that such main lens arrangement challenges the "conventional wisdom" that color tube electron guns always require focus and anode grids with aperture plates to converge and focus the three electron beams. The main lens arrangement of the invention offers improvement because the lens acting on each electron beam is larger, thereby advantageously producing an electron beam having a spot size that is smaller than that of conventional commercial electron guns, while also providing low aberration and spot distortion. This electron gun utilizes the gun grids acting on the electron beams prior to the main lens to compensate for the different focus voltages and aberrations experienced by the center and outer beams as they are acted upon in the main lens. Further, the structure of electron gun 26 is simplified by the elimination of a convergence grid and may be shorter in length and lower in cost than are conventional commercial electron guns.

The upper end of focus grid G5 is formed of a shaped hollow tube 50 having an aperture plate 52 through which electron beams 28 enter the upper end of focus grid G5 and an exit opening 54 though which electron beams 28 leave focus grid G5. Aperture plate 52 is preferably a plate 52 having three openings, one for each of the three electron beams. Hollow grid tube 50 is preferably metal or is coated with a metal or other electrically conductive material, and is preferably shaped at each end, such as by rolling over or otherwise forming the conductive material at the plate 52 and at the exit opening 54 to reduce the tendency for arcing when high electrical bias potential is applied thereto. The lower end of focus grid G5 is preferably a plate having three openings, one for each of the three electron beams 28, and is shaped to reduce arcing.

Neck coating 60 is formed of an electrically conductive material deposited on the interior surface of tube neck 14 to form a cylindrical electrode thereon through which electron beams 28 pass. Conductive coating 60 is preferably a metal, conductive metal compound or another electrically conductive material, such as iron oxide, aluminum or carbon, and is deposited by flow coating, brushing, spraying, spin coating, or other suitable method. Also preferably, conductive coating 60 of cylindrical neck coating 60 extends into tube neck 14 beyond the exit opening 54 of hollow tube 50 of focus grid G5 so that exit opening 54 and at least part of hollow tube 50 is within and is surrounded by conductive coating 60, i.e. grids G5 and coating 60 are "telescoped" or overlap.

Exit opening 54 of focus grid G5 and the central region of neck coating 60 as well as the respective interior volumes thereof are "open" in that the exit opening of grid G5 is substantially the full dimension of the central portion of hollow tube 50 and of neck coating 60 is substantially the full dimension of the tube neck 14. Springs or other supports attached to tube 50 contact tube neck 14 to center and support electron gun 26 therein, but do not make electrical contact with conductive coating 60. Preferably opening 54, hollow tube 50 and neck 14 are cylindrical, i.e. have circular cross-section, however, metal tube 50 may have a somewhat non-circular cross-section such as an oval or an ellipse shape. For example, the aperture plate 52 end of hollow tube 50 may be elliptical or "racetrack" shaped to allow room for the glass beads (not shown) that support the various elements of electron gun 26.

Preferably, the centers of opening 54 and of conductive coating 60 lie on the Z axis and have reflection symmetry in the X-Z and Y-Z planes. The entrance to the upper end of focus grid G5 preferably includes a plate 52 having three openings 52R, 52G, 52B, one for each of the three electron beams 28R, 28G, 28B, positioned and shaped as may be appropriate to produce a particular desired characteristic such as spot size, focus and/or convergence of the electron beams 28, as described below.

The length of focus grid GS refers to the distance between lower end plate 51 and exit opening 54, i.e. in the Z-axis direction which is the direction of electron travel. This dimension of a grid or electrode structure is usually referred to herein as the "length" of the grid or electrode structure. The length of hollow tube 50 at the upper end of grid G5 is varied, for example, so as to produce an exit opening 54 that is non planar, which may also be referred to as being shaped, curved or "undulating." The non-planar shaping of the open exit opening 54 of focus electrode G5 provides certain advantage to the present invention. The lengths of focus grid GS in the X-Z plane (the plane of all three beams) and in the Y-Z plane define the amplitude and phase of the undulation in length of focus grid GS which varies with an angle $\Theta$ about the tube axis (the Z axis). For example, the length of focus grid GS may vary in proportion to the function $\cos 2\Theta$.

Specifically, in the exemplary embodiment of FIGS. 2A, 2B and 2C, the length of focus grid G5 is greatest in the X-Z plane and is least in the Y-Z plane as is desirable for focusing and converging the three electron beams 28 to a common spot on screen 22. This curvature or undulated shape of focus grid G5 intervenes between electron beams 28 and neck coating 60 thereby effectively curving or undulating the effective "entrance" to the field produced by neck coating 60 oppositely in the Z-axis direction so as to produce an effective entrance that is similarly non planar. Specifically, the effective length of neck coating 60 is effectively opposite that of focus grid G5, i.e. it is least in the X-Z plane and is greatest in the Y-Z plane. Focus grid G5 is preferably centrally located within tube neck 14 to maintain a uniform gap or spacing or separation between focus grid G5 and neck coating 60.

The curvature of exit opening 54 of focus electrode G5 that makes the length thereof less in the Y-Z plane causes focus grid G5 to be "shorter" or "thinner" (or to have a "smaller Z extent") where it acts upon the center beam 28G and "longer" or "thicker" (or to have a "greater Z extent") where it acts upon the outer beams 28R, 28B, thereby to have a greater effect on the outer beams 28R, 28B to bend those beams towards center beam 28G. As a result, electron beams 28R, 28G, 28B exit electron gun 26 with outer beams 28R, 28B directed slightly towards center beam 28G preferably to converge therewith at screen 22, i.e. to impinge on screen 22 at a common spot. Thus the embodiment of electron gun 26 shown in FIGS. 2A, 2B, 2C lends itself to being designed to improve or optimize the convergence of the electron beams on the phosphor screen while maintaining focus and small spot size.

FIG. 3 is a graphical schematic representation illustrating the relative positions in the X-Z plane of the various grids that influence the electron trajectories of the electron beams 28 within an exemplary electron gun 26, including the electrode structure of FIGS. 2A, 2B and 2C, viewed in cross-section in the X-Z plane.

FIG. 3 depicts as dashed lines typical trajectories of center beam 28G and outer electron beams 28R, 28B of electron gun 26. The region to the left of Z=−40 mm includes three separate triode structures comprising respective cathodes KR, KG, KB from which the beams of electrons originate and the G1 and G2 grids, and the entrance to the G3 grid, associated therewith that fonn the respective electron beams 28R, 28G, 28B. Each of the G1 grid, G2 grid and G3 grid may have three circular apertures in line, one for each of the three electron beams 28R, 28G, 28B.

The pre-focus lens comprises the exit of grid G3, pre-focus grid G4 and the entrance 51 to focus grid G5. Entrance 51 is preferably a plate 51 having three circular openings therein, one for each of the three beams of electron beam 28. Typically, the outer apertures thereof are aligned and displaced or offset from the Z axis a like distance to that of cathodes KR, KB and triode electrodes G1, G3. The pre-focus lens is located in the region near Z=−35 mm, e.g., between Z=−30 mm and Z=−40 mm. It is noted that the length of the G3 grid is preferably kept relatively short so as not to increase the sensitivity of the beam placement in the main lens to changes in the beam as acted upon by the pre-focus lens. Preferably, pre-focus grid G4 is electrically connected to the G2 grid and focus grid G5 is electrically connected to the G3 grid. It is noted that the lower and upper ends of focus grid G5 may be formed as a single joined structure as suggested by the dashed lines between plate 51 and hollow tube 50 in FIG. 3, or may be formed of two separate spaced-apart structures, e.g., a plate 51 and a hollow tube 50.

With respect to the focus of the outer beams 28R, 28B, the apertures therefor in the pre-focus grid G4 may be changed from circular to rectangular or oval shape, or slots could be added at the sides and/or top and/or bottom of the G4 outer apertures. Alternatively and/or in addition, the G1-G2-G3 triode structures for the outer beams 28R, 28B could be displaced or offset in the ±X directions either outwardly (away from the Z axis) or inwardly (toward the Z axis) with respect to the outer apertures of the outer beam triodes, but to remain substantially parallel to the Z axis, e.g., where advantageous for adjusting convergence.

The main lens comprising coaxially-positioned focus grid G5 and neck coating 60 is as described above, and neck coating 60 is preferably biased at the same potential as is screen 22. The main lens comprising focus grid G5 and neck coating 60 is located in the region near Z=0 mm, for example, in a cathode ray tube 10 wherein phosphor screen 22 is located at Z=280 mm. With the undulation of the exit opening 54 of focus grid G5 being to produce a G5 length that is greater in the horizontal or X-Z plane than in the vertical or Y-Z plane, the main lens is arranged for improved convergence of the three electron beams 28. In particular, focus grid G5 includes a lower end entrance plate 51 located at about Z=−33 mm and a hollow tube 50 structure located between about Z=−5 mm and Z=0 mm.

Figure 4A:
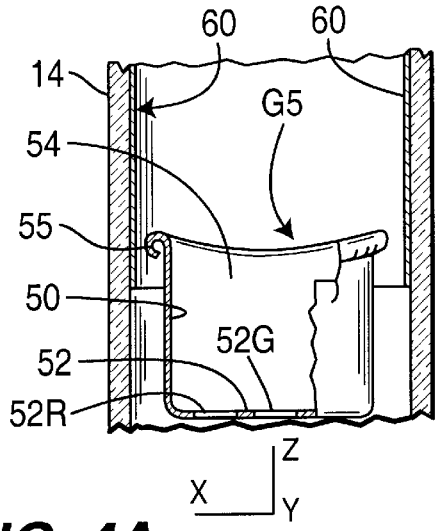
FIGS. 4A and 4B are two side partial cross-sectional views of a portion of the neck of the tube of FIG. 1 illustrating an exemplary focus electrode structure of FIGS. 2A–2C therein.
Figure 4B:
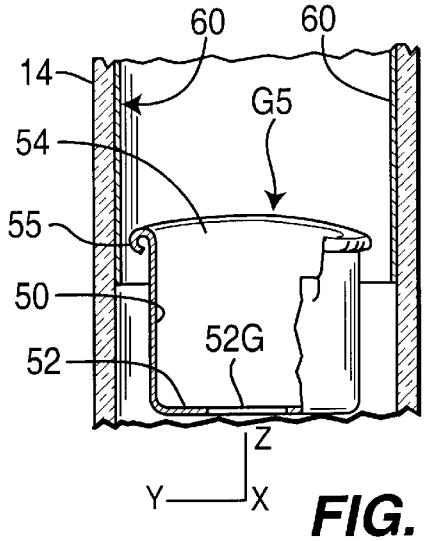

FIGS. 4A and 4B are two side partial cross-sectional views, one in the X-Z plane and the other in the Y-Z plane, of a portion of the neck 14 of tube 10 of FIG. 1 illustrating an exemplary upper end of focus electrode G5 and neck coating 60 structure therein. The upper end of focus grid G5 is, e.g., a metal cup having a hollow cylindrical tube portion 50 and fundus serving as aperture plate 52 in which are apertures or openings 52R, 52G, 52B through which electron beams 28R, 28G, 28B, respectively, pass. The depth of cup 50 is less in the vertical direction or Y-Z plane than it is in the horizontal or X-Z plane. Conductive coating 60 on the interior surface of tube neck 14 is coaxial with and overlaps focus grid G5 to serve as anode. The exit opening 54 of focus grid G5 is rolled over 55 to reduce arcing. Where neck coating 60 is biased at screen potential, neck coating 60 extends from a location within tube neck 14 behind exit opening 54 of focus grid G5 to screen 22 on faceplate 18.

Figure 5:
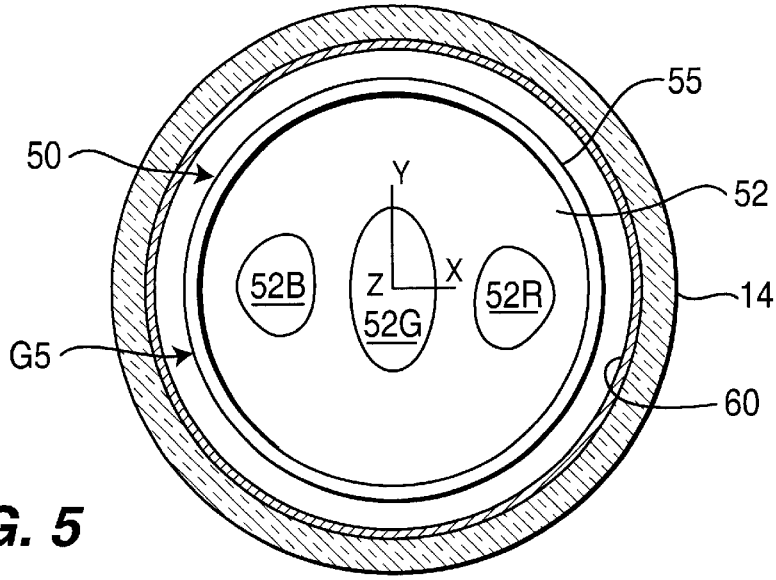
FIG. 5 is a cross-sectional view of the neck of the tube of FIGS. 1 and 4A–4B also illustrating an exemplary focus electrode structure therein.

FIG. 5 is a cross-sectional view of the neck 14 of tube 10 of FIGS. 1, 4A and 4B also illustrating an exemplary hollow tube 50 therein providing the upper end of focus electrode G5. In particular, neck 14 is sectioned in the X-Y plane to provide a view looking into the metal cup 50 that is the part of focus grid G5 which is surrounded by conductive coating 60 on the inner surface of tube neck 14. In aperture plate 52 of the upper end of focus grid G5 are apertures or openings 52R, 52G, 52B through which the three electron beams 28R, 28G, 28B, respectively, enter the upper end of focus grid G5. Preferably, apertures or openings 52R, 52G, 52B are non-circular, and are shaped to better form the aberration of electron beams 28, as described in relation to FIG. 6.

Figure 6:
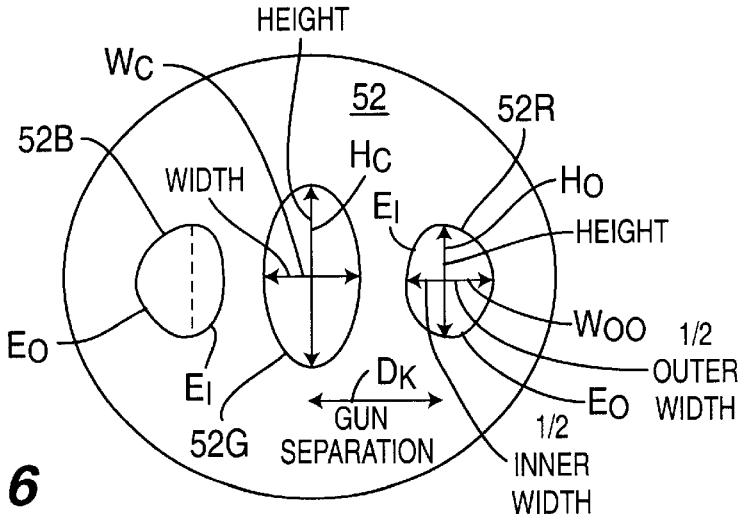
FIG. 6 is a schematic diagram of a portion of the focus electrode useful with the embodiments of FIGS. 2A, 2B, 2C, 4A, 4B and 5.

FIG. 6 is a plan view of a portion of preferably circular aperture plate 52 of hollow tube 50 of focus electrode G5 useful with the embodiments of FIGS. 2A, 2B, 2C, 4A, 4B and 5. Preferably, the diameter of plate 52 is the same as the diameter of exit opening 54 of focus grid G5. Also preferably, center opening 52G is elliptical with its major axis dimension or height $H_C$ in the vertical or Y axis direction being greater than is its minor axis dimension or width $W_C$ in the horizontal or X axis direction. Preferably, outer openings 52R, 52B are spaced away from the tube centerline on the Z axis (i.e. the center of elliptical opening 52G) by the same dimension $D_K$ as are the electron sources KR, KB. Outer openings 52R, 52B are preferably comprised of two connected half ellipses or semi-ellipses $E_I$, $E_O$ having the same major axis dimension, which dimension is the height $H_O$ of openings 52R, 52B. Semi-ellipses $E_O$, $E_I$ are joined at a vertical line that is common to the major axis of both semi-ellipses. The proximal or inner half ellipse $E_O$ (i.e. that closer or proximal to central opening 52G) of each outer opening 52R, 52B has a minor axis dimension $2W_{OI}$ that is smaller than the minor axis dimension $2W_{OO}$ of the distal or more remote half ellipse $E_O$ (i.e. that distal from center opening 52G and closer to the periphery of plate 52 ).

In other words, each outer opening 52R, 52B has an inner-width dimension $W_{OI}$ that is smaller than its outer-width dimension $W_{OO}$. It is noted that the dimensions of apertures 52R, 52G, 52B are preferably selected to provide the desired convergence, astigmatism and focus balance of three electron beams 28R, 28G, 28B.

Exemplary dimensions and electrical parameters for typical cathode ray tubes and electron gun structures embodying the invention, such as the arrangement of FIGS. 2A–2C and the arrangement of FIGS. 4A, 4B, 5 and 6, are presented in the following table in which width refers to the X direction, height refers to the Y direction and thickness or length refer to the Z direction:

| DIMENSION | VALUE | | UNITS OF MEASURE |
|---|---|---|---|
| TUBE: | | | |
| Screen diagonal; 100° deflection | 19/483 | | inches/mm |
| Depth, G5 exit to screen | 280 | | mm |
| Neck diameter | 22.5 | (outer) | mm |
| | 20.3 | (inner) | mm |
| Gun length | 44 | | mm |
| Beam current | 300 | | μamps |
| Beam spot size (H × V) | 0.44 × 0.25 | (center) | mm |
| | 0.42 × 0.34 | (outer) | |
| GUN TRIODE: | | | |
| Gun separation | 4.75 | | mm |
| K–G1 separation | 0.075 | | mm |
| G1 & G2 aperture | 0.380 | diameter | mm |
| G1 thickness | 0.075 | | mm |
| G1–G2 separation | 0.250 | | mm |
| G2 thickness | 0.200 | | mm |
| G2–G3 separation | 1.00 | | mm |
| G3 entrance aperture | 1.50 | diameter | mm |
| PRE-FOCUS LENS: | | | |
| G3 length | 5.00 | | mm |
| G3 exit aperture | 3.90 | diameter | mm |
| G3–G4 separation | 0.700 | | mm |
| G4 aperture: | 3.90 | diameter | mm |
| G4 thickness | 0.600 | | mm |
| G4–G5 separation | 0.700 | | mm |
| G5 entrance aperture | 3.90 | diameter | mm |
| MAIN FOCUS LENS | | | |
| G5 center aperture $W_C$ | 3.56 | width | mm |
| $H_C$ | 7.36 | height | mm |
| G5 outer apertures $W_{OI}$ | 3.81 | inner width | mm |
| $W_{OO}$ | 5.84 | outer width | mm |
| $H_O$ | 5.59 | height | mm |
| G5 cup depth | 4.50 | | mm |
| G5 exit opening | 15.2 | diameter | mm |
| G5 length, X–Z plane | 35.5 | | mm |
| Y–Z plane | 34.5 | | mm |
| undulation in length | 1.0 | | mm |
| 60 entrance and exit | 20.3 | diameter | mm |
| openings | | | mm |
| BIAS POTENTIALS | | | |
| Cathode K | 68.4 | | volts |
| G1 | 0 | | volts |
| G2 | 629 | | volts |
| G3 and G5 | 6600 | | volts |
| G4 | 629 | | volts |
| 60 and screen | 26000 | | volts |

It is noted that as a result of electron gun 26 fitting within a smaller diameter tube neck 14, e.g., a 22.5 mm diameter neck rather than a 29 mm diameter neck, the energy required for deflection yoke 30 to produce deflection of electron beams 28 is beneficially reduced.

Variations in the roundness or circularity of the tube neck glass and/or in the alignment of the electron gun within the tube neck, which produce astigmatism, for example, are correctable with a convergence purity magnet assembly as in conventional cathode ray tubes. The convergence purity magnet assembly may be of conventional or increased magnet strength. Alternatively, a greater precision can be specified for the roundness of the tube neck glass. The gun alignment and support springs are located rearward of the exit of focus grid G5 so as to not contact neck coating 60 which is typically biased at screen potential, and the neck-to-funnel splice is sufficiently forward so as not to significantly perturb the electron lens. It is noted that the coating material utilized for coating 60 operates in a relatively high electric field strength region proximate focus grid G5 and should not release conductive particles, such as iron oxide particles, or otherwise promote arcing in the neck region which can be destructive to the cathodes and to the tube. Getter material is placed at one or more convenient locations, such as at the tube anode bias button or on the shadow mask support frame.

While the present invention has been described in terms of the foregoing exemplary embodiments, variations within the scope and spirit of the present invention as defined by the claims following will be apparent to those skilled in the art. For example, the circular shape of the focus grid G5 entrance plate 52 and exit opening 54 need not be strictly a circular opening as illustrated in FIGS. 5 and 6, but may be elliptical or oval shaped. Such minor changes from the fully open circular lens shape is deemed to provide an open or substantially open main lens, and may allow additional flexibility in controlling the astigmatism, spot size, aberration and other parameters of various ones of the three electron beams.

Tubes according to the invention may be employed in color television receivers, computer displays, video monitors, color displays and any other apparatus employing a cathode ray tube to produce a color image display. In view of the interplay between spot size and beam convergence, dynamic voltage modulation of the focus grid G5, G5' and/or the pre-focus grid G4 may be utilized to ensure good spot focus when the electron beam is deflected to land near the edges of the screen while maintaining proper convergence.

What is claimed is:

1. An electron gun for producing at least three beams of electrons at an exit thereof comprising:

at least three electron sources for producing the at least three beams of electrons;

a pre-focus lens for at least partly focusing each of the beams of electrons;

a main lens of the electron gun including a hollow electrode at the exit of the electron gun for focusing and converging the at least three beams of electrons, said hollow electrode having a non-uniform dunension in the direction of electron travel therethrough thereby to define a substantially open non-planar exit aperture at the exit of the electron gun.

2. The electron gun of claim 1 wherein the electron beams are substantially side by side in a first plane within said main lens, and wherein the dimension in the direction of electron travel through said hollow electrode is one of smaller and larger in the first plane than in a second plane orthogonal thereto.

3. The electron gun of claim 1 wherein said hollow electrode includes a hollow tube substantially open at least at one end thereof.

4. The electron gun of claim 1 wherein said hollow electrode includes an entrance having at least three apertures through which respective ones of the at least three beams of electrons pass.

5. The electron gun of claim 1 wherein said hollow electrode includes an aperture plate positioned intermediate the non-planar exit aperture and an entrance thereto, said aperture plate having at least a center aperture and two outer apertures therein.

6. The electron gun of claim 5 wherein the center aperture has a shape defined by an ellipse and wherein the outer apertures each have a shape defined by two connected semi-ellipses.

7. The electron gun of claim 1 wherein said hollow electrode is circular in cross-section.

8. The electron gun of claim 1 wherein said electron gun has a central axis, and wherein the pre-focus lens for at least one of the electron beams is spaced laterally away from the central axis more than is the electron source for that at least one electron beam.

9. The electron gun of claim 1 in combination with a cylindrical tube neck having a conductive coating on an interior surface thereof, wherein said hollow electrode includes a hollow tube disposed co-axially along a central axis of said cylindrical tube neck.

10. An electron gun for producing at least three beams of electrons at an exit thereof comprising:

at least three electron sources for producing the at least three beams of electrons;

a pre-focus lens for at least partly focusing each of the beams of electrons;

a main lens of the electron gun including a hollow electrode at the exit of the electron gun for focusing and converging the at least three beams of electrons, said hollow electrode having an entrance and having an exit opening at the exit of the electron gun, and an aperture plate intermediate the entrance and the exit opening, wherein the aperture plate has at least an elliptical center opening and two outer openings defined by two connected semi-ellipses through which respective ones of the at least three electron beams pass.

11. The electron gun of claim 10 wherein the exit opening of said hollow electrode is substantially open.

12. The electron gun of claim 10 wherein said hollow electrode has a non-unifonn dimension in the direction of electron travel therethrough thereby to define a non-planar exit opening.

13. The electron gun of claim 10 wherein the electron beams are substantially side by side in a first plane within said main lens, and wherein the dimension in the direction of electron travel through said hollow electrode is one of smaller and larger in the first plane than in a second plane orthogonal thereto.

14. The electron gun of claim 10 wherein said hollow electrode is circular in cross-section.

15. The electron gun of claim 10 wherein said electron gun has a central axis, and wherein the pre-focus lens for at least one of the electron beams is spaced laterally away from the central axis more than is the electron source for that at least one electron beam.

16. The electron gun of claim 10 in combination with a cylindrical tube neck having a conductive coating on an interior surface thereof, wherein said hollow electrode includes a hollow tube disposed co-axially along a central axis of said cylindrical tube neck.

17. An in-line electron gun for producing three beams of electrons at an exit thereof comprising:

at least three electron sources disposed in-line for producing three substantially co-planar beams of electrons;

a pre-focus lens for at least partly focusing each of the beams of electrons;

a main lens including a focus grid including a hollow tube having an entrance, a substantially open exit opening at the exit of the electron gun and a non-uniform dimension in the direction of electron travel therethrough, thereby to define a non-planar exit opening at the exit of the electron gun, and having an aperture plate intermediate the entrance and the open exit opening, wherein said aperture plate has at least an elliptical center opening and two outer openings defined by two connected serni-ellipses through which respective ones of the at least three electron beams pass.

18. The in-line electron gun of claim 17 wherein the three substantially co-planar beams of electrons define a first plane and travel in a first direction through said focus grid, and wherein a central one of the three substantially co-planar beams of electrons defines a second plane orthogonal to the first plane, wherein the dimension of said focus grid in the first direction is one of smaller and larger in the first plane than in the second plane.

19. The in-line electron gun of claim 17 wherein said focus grid is circular in cross-section.

20. The in-line electron gun of claim 17 in combination with a cylindrical tube neck having a conductive coating on an interior surface thereof, wherein said hollow tube disposed co-axially along a central axis of said cylindrical tube neck.

21. In a cathode ray tube including a neck, a funnel and a faceplate having an anode thereon for biasing at a positive anode potential, and having an electron gun in the neck thereof that produces at an exit of the electron gun at least three beams of electrons directed toward the faceplate, the improvement comprising:

a main lens of the electron gun including two spaced-apart electrodes for focusing and converging the at least three beams of electrons, a first of said electrodes having a non-uniform dimension in the direction of electron travel therethrough thereby to define a substantially open non-planar exit opening at the exit of the electron gun, and a second of said electrodes including a conductive coating on an inner surface of said tube neck, wherein the first electrode is biased at a different positive potential than is the conductive coating.

22. The cathode ray tube of claim 21 wherein the electron beams are substantially side by side in a first plane within said main lens, and wherein the dimension in the direction of electron travel through the first of said two electrodes is one of smaller and larger in the first plane than in a second plane orthogonal thereto.

23. The cathode ray tube of claim 21 wherein the first of said electrodes includes a hollow tube substantially open at the end thereof at which the beams of electrons exit therefrom.

24. The cathode ray tube of claim 23 wherein said hollow tube has a circular cross-section.

25. The cathode ray tube of claim 21 wherein the first of said electrodes includes a hollow tube disposed co-axially along a central axis of said tube neck, wherein the entrance of said hollow tube includes a separate aperture for each of said at least three electron beams, and wherein the exit opening of said first hollow tube is substantially open.

26. In a cathode ray tube including a neck, a funnel and a faceplate and having an electron gun in the neck thereof that produces at an exit of the electron gun at least three beams of electrons directed toward the faceplate, the improvement comprising:

a lain lens of the electron gun including two spaced-apart electrodes for focusing and converging the at least three beams of electrons, a first of said electrodes including a hollow tube disposed co-axially along a central axis of said tube neck and having a non-uniform dimension in the direction of electron travel therethrough, thereby to define a non-planar exit opening at the exit of the electron gun, wherein the entrance of said hollow tube has at least an elliptical center opening and two outer openings each defined by two connected semi-ellipses through which respective ones of the at least three electron beams pass and wherein the exit opening of said first hollow tube is substantially open; and a second of said electrodes including a conductive coating on an inner surface of said tube neck, wherein the first electrode is biased at a different potential than is the conductive coating.

27. In a cathode ray tube including a neck, a funnel and a faceplate and having an electron gun in the neck thereof that produces at an exit of the electron gun at least three beams of electrons directed toward the faceplate, the improvement comprising:

a main lens of the electron gun including two spaced-apart electrodes for focusing and converging the at least three beams of electrons, a first of said electrodes having a substantially open exit opening at the exit of the electron gun and an aperture plate having at least an elliptical center opening and two outer openings each defined by two connected semi-ellipses through which respective ones of the at least three electron beams pass, and a second of said electrodes including a conductive coating on an inner surface of said tube neck, wherein the first electrode is biased at a diferent potential than is the conductive coating.

28. The cathode ray tube of claim 27 wherein the first of said electrodes has a non-uniform dimension in the direction of electron travel therethrough thereby to define a non-planar exit opening.

29. The cathode ray tube of claim 28 wherein the electron beams are substantially side by side in a first plane within said main lens, and wherein the dimension in the direction of electron travel through the first of said two electrodes is one of smaller and larger in the first plane than in a second plane orthogonal thereto.

30. The cathode ray tube of claim 27 wherein said first of said electrodes includes a hollow tube having a circular cross-section.

* * * * *